United States Patent [19]

Leber

[11] 4,149,481

[45] Apr. 17, 1979

[54] SUPPORTING STRUCTURE FOR SAIL MAST

[75] Inventor: Edmond Leber, Buhl, France

[73] Assignee: Sevylor, France

[21] Appl. No.: 839,904

[22] Filed: Oct. 6, 1977

[30] Foreign Application Priority Data

Oct. 8, 1976 [FR] France ..... 76 30847

[51] Int. Cl.[2] ..... B63B 7/00

[52] U.S. Cl. ..... 114/39; 9/11 A

[58] Field of Search ..... 9/1.1, 1.3, 1.7, 2 A, 9/11 A; 114/43, 39, 102; 280/213

[56] References Cited

U.S. PATENT DOCUMENTS 3,601,076 8/1971 Meeks ..... 9/2 A

FOREIGN PATENT DOCUMENTS 16566 12/1955 Fed. Rep. of Germany ..... 9/2 A 1188972 3/1965 Fed. Rep. of Germany ..... 9/2 A

*Primary Examiner*—Trygve M. Blix

*Assistant Examiner*—Jesus D. Sotelo

*Attorney, Agent, or Firm*—Robert E. Burns; Emmanuel J. Lobato; Bruce L. Adams

[57] ABSTRACT

This sail mast supporting brace structure of Y or T configuration is intended for a single-hull boat and comprises three arms adapted to be secured one to the bow and the other two to the lateral portions of an inflatable hull; the side arms are adapted to cooperate with telesopic elements engaging the holes of rowlocks carried by said lateral portions. The arrangement is such that the boat can easily be operated with or without sails, without having to deflate the hull.

6 Claims, 3 Drawing Figures

SUPPORTING STRUCTURE FOR SAIL MAST

FIELD OF THE INVENTION

The present invention relates to supporting devices or structures for sail masts, which are intended for single-hull boats, the hull comprising one or a plurality of inflatable elements disposed at least on the sides and fore of the hull.

DESCRIPTION OF THE PRIOR ART

In known supporting devices of this character the mast is carried by a pair of boards. The first board is disposed transversely on the upper portion of the hull and interconnects the inflated elements constituting the two sides of said hull; its central portion comprises an orifice through which the lower portion of the mast extends. The other board disposed parallel to the first one bears on an inflated mattress constituting the hull bottom; each end of this second board is simply clamped between the mattress and the inflated hull elements overlying this mattress; the central portion of this second board comprises a cavity adapted to receive the bottom end of the mast. As a rule, these known sail mast supporting structures are utilized without resorting to guys or struts, for securing the latter to a flexible hull makes it impossible to keep the sail mast in a fixed position in relation to the inflatable hull; moreover, the second board tends to slip due to the inherent resiliency of the mattress on which it bears, and this constitutes another reason preventing the mast from being kept in a fixed position. Likewise, with these known structures it is definitely impossible to properly spread the jib for any stretching thereof will either cause the bow to nose up or the mast to tilt forwards and thus facilitate the backward sliding movement of the second board. On the other hand, fitting these boards in position is a tedious and time-robbing operation, and it is also difficult to properly set them in relation to each other in order to position the mast correctly, and furthermore these operations cannot be carried out unless the boat is only partially inflated, and this may constitute an unpleasant inconvenience when it is desired to utilize the hull in its fully inflated condition alternatively with and without mast and sails.

SUMMARY OF THE INVENTION

With the supporting device according to this invention the above-described shortcomings can safely be avoided. In fact, with this supporting structure the mast can be positioned firmly in a fixed position in relation to said supporting device; if desired, guys and stays may be used so as to partake in the proper holding of the mast in position on the frame structure; in addition, the jib can be spread properly without causing the bow to nose up unduly or the mast to tilt forwards; on the other hand, the design of this supporting device is such that the fastening thereof to the inflated hull affords a maximum preservation of the original hull shape and therefore of the assembly comprising said structure and said hull. Finally, the supporting device and the mast can be fitted very rapidly to the inflated hull without having to deflate the latter partially and momentarily; if desired, they can be separated very rapidly from the hull; under these conditions, it is extremely easy to utilize a single-hull inflatable boat alternatively with and without sails.

The supporting device according to this invention comprises a rigid brace structure of which at least one portion is adapted to act as a support for the mast bottom; at least one first portion of this brace structure is adapted to be secured to the bow of the hull either directly or to an intermediate element secured in turn by at least two portions thereof to the bow; at least two other lateral portions of said brace structure are adapted to be secured, directly or not, each to one side of the hull.

According to a preferred embodiment the rigid brace structure is substantially Y-shaped with two arms thereof adapted to be secured each to one side of the hull, the third arm being adapted to be secured to the bow. According to a modified embodiment the rigid brace structure is T-shaped and the cross member of the T is adapted to be secured substantially at its ends to the two sides of the hull elements, and the vertical member of the T is adapted to be secured to the bow. The portion of the brace structure that supports the mast may be located at different points of the structure; thus, in the case of a Y-shaped structure, it may be coincident with the center of a spider interconnecting the three arms of the Y, and in the case of a T-shaped structure, it may be disposed on the element constituting the vertical element of the T.

According to another form of embodiment, the two lateral portions of the brace structure, each adapted to be secured to one side of the hull, can be attached directly to the hull by engaging the holes of the rowlocks (oarlocks) rigid with the hull. According to a further modification, the two lateral portions of the brace structure are each adapted to be secured to the hull through the medium of an element adapted to be secured in turn to at least two portions on the corresponding side of the hull. In a modified form of embodiment, this intermediate element is telescopic and each one of the two sections in mutual sliding engagement constituting this element is adapted to be secured to the hull; advantageously but not compulsorily, this mounting may be such that the shape of the two telescopically engaged sections of this intermediate element enables said sections to co-act with the orifices of the rowlocks rigidly secured to the hull. In case the lateral portions of the brace structure can be secured to the hull by means of intermediate elements, a lateral portion of the structure comprises means for fastening same to the corresponding intermediate element which consist, advantageously but not compulsorily of a guide member such as a tubular member rigid therewith and disposed at least substantially parallel to the corresponding hull side, the dimensions of this guide member being such as to permit its engagement with one portion of said intermediate element.

According to a typical form of embodiment of the device, the brace structure comprises means for securing a stay and a pair of guys disposed on the one hand on the first front portion and on the other hand on the two other lateral portions of said structure. In a modified embodiment, the means for securing the pair of guys are provided on the two intermediate elements or on guide means provided for co-operating therewith.

It would not constitute a departure from the scope of the present invention to attach the stay and the pair of guys to the hull proper, in close proximity of the points of attachment of the other two lateral portions of the brace structure, for example on the rowlocks proper.

DESCRIPTION OF THE PREFERRED EMBODIMENTS

Figure 1:
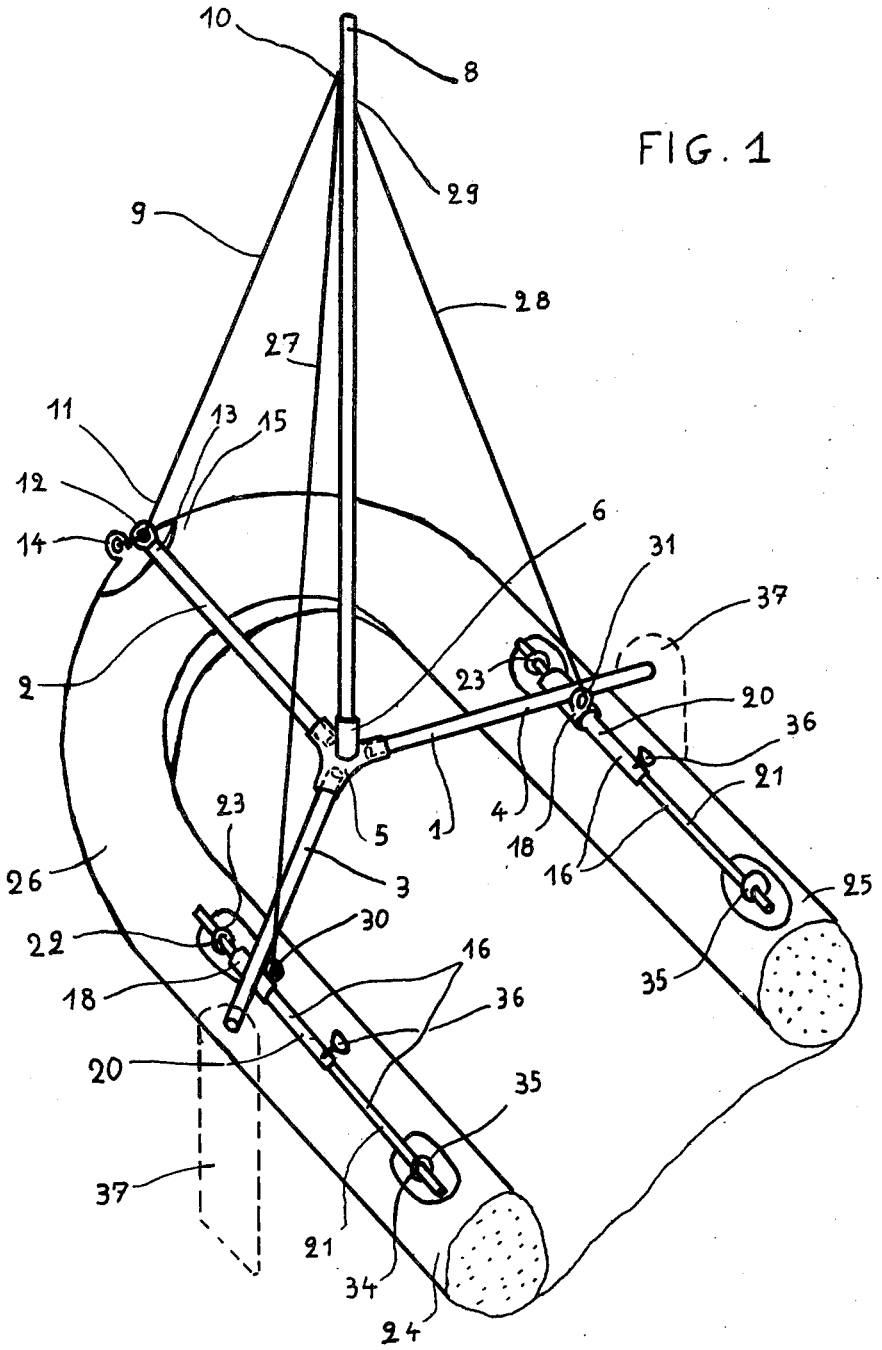
FIG. 1 illustrates in perspective view a first form of embodiment of the present invention.
Figure 2:
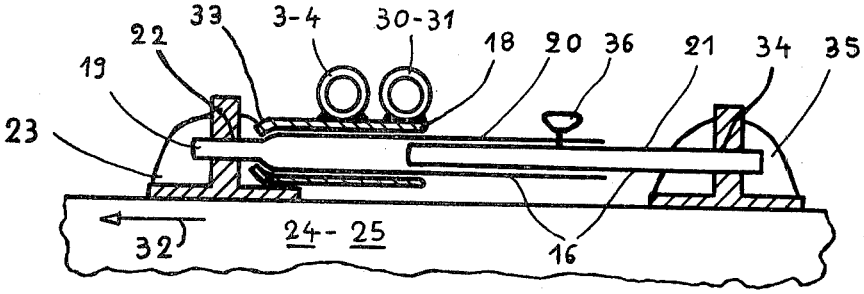
FIG. 2 illustrates diagrammatically in fragmentary, sectional, slightly modified view a detail of the first form of embodiment, the section being taken along the line II-II of FIG. 1.

In the embodiment illustrated in FIG. 1 the supporting device comprises a rigid brace structure 1 consisting of three rigid stararranged arms 2, 3 and 4 interconnected by a three-armed Y-shaped spider 5 and angularly diverging therefrom as shown. The arms 2, 3 and 4 of this brace structure 1 have first or inner ends engaged in the corresponding sockets of spider 5 so as to form likewise a Y-shaped assembly. The connecting spider 5 comprises centrally of its upper portion a hollow vertical socket 6 of which the inner diameter corresponds to the diameter of the lower part of the main sail mast 8. Alternatively, this spider could comprise a vertical element of a diameter permitting its engagement into the hollow base of said mast 8. A stay 9 has a first end 10 attached to the upper portion of mast 8 and its opposite end 11 connected to a ring 12 carried by the second or outer end of arm 2. Another ring 14 is provided at the bow or fore-float 15 of hull 26 for the purpose of connecting the end 13 of arm 2 to the bow 15 by utilizing the outer end of stay 9. The other two arms 3 and 4 of the brace structure 1 comprise each, as illustrated in detail in FIG. 2, a tubular member 18 welded or otherwise secured thereto, transversely thereof. Each tubular member 18 is substantially parallel to the corresponding side 24 or 25 of hull 26, and its dimensions are such that it can be slidably engaged by one section, 20, of an intermediate telescopic unit 16. The adjustment of this section 20 in the direction of the arrow 32 (FIG. 2) is limited by a constricted end portion 33 of tubular member 18; the end 19 of said section 20 is shaped and dimensioned to permit its engagement through the hole of a rowlock 23 rigidly connected to the corresponding side of the generally flexible hull 26. Slidably engaged in each telescopic section 20 is another section 21 adapted to engage the hole 34 of another rowlock 35 coaxially aligned with the preceding one (23) and also rigid with the top portion of the hull. A set screw of the butterfly type 36 is provided for locking this section 21 in relation to the other section 20 in the desired adjustment portion. A pair of guys 27 and 28 are attached, each at one end 29 to the upper portion of mast 8 and at their opposite end to rings 30 and 31, respectively, said rings being welded to the lateral tubular member 18 in this example.

In this specific form of embodiment, the inflatable part of hull 26 consists of a single inflatable element constituting both the bow 15 and the side floats 24 and 25 of said hull 26. As illustrated in FIG. 1, the ends of the lateral arms 3 and 4 may advantageously be utilized for securing the side boards or keels 37 shown in dash lines in FIG. 1.

For setting sails on a single-hull boat 26 the operator firstly engages the arms 2, 3 and 4 into the corresponding socket of spider 5, then the base of mast 8 into its upstanding socket 6. The stay 9 and guys 27, 28 already attached to the mast 8 are subsequently attached to rings 12, 30 and 31. The next step comprises inflating the hull 26 completely and then disposing the components 2, 3, 4 and 8 thereon. At the fore, the end 13 of arm 2 is attached to the bow 15 of hull 26 with the assistance of the end portion of stay 9 passing through ring 14 and tied by forming a suitable knot. To secure each lateral arm 3, 4 the section 20 of each telescopic intermediate element 16 is engaged in the direction of the arrow 32 into the corresponding tubular member 18 and also through the hole 22 of rowlock 23; the other section 21 is then moved in the opposite direction until it engages the hole 34 of the rear rowlock 35. The butterfly screws 36 are eventually tightened home and thus the structure 1, mast 8 and hull 26 will form a rigid, unitary assembly.

Figure 3:
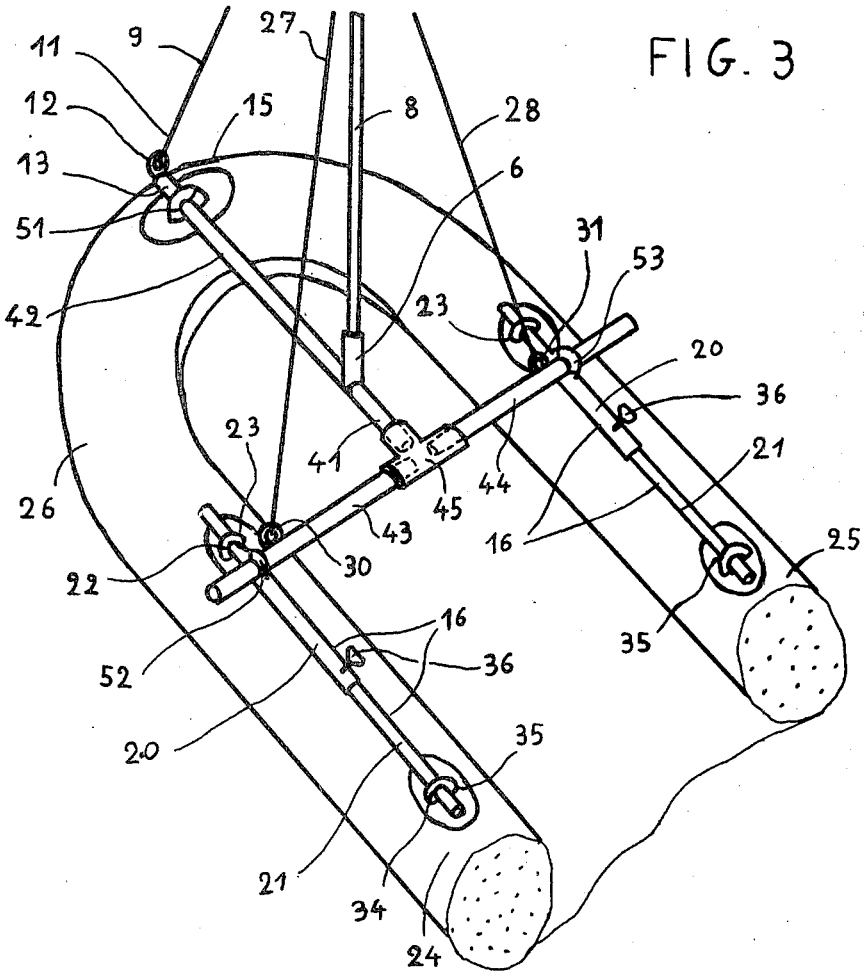
FIG. 3 is perspective view showing another form of embodiment of this invention.

In the modified embodiment illustrated in FIG. 3 the supporting structure 41 substituted for the structure 1 of FIG. 1 comprises three rigid arms 42, 43 and 44 rigidly assembled by means of a T-shaped tubular fitting 45. The arms 42, 43 and 44 of this structure 41 have one end fitted into a corresponding socket of the T-shaped fitting 45 so that they also form a Tee together. The front arm 42 disposed longitudinally or fore-and-aft along the center line of the boat carries the vertical support 6 for the mast 8. The ring 14 and tubular members 18 of the first form of embodiment are dispensed with in this modified structure, and replaced by detachable straps designated by the reference numerals 51, 52 and 53, respectively. Strap 51 is rigid with the bow 15 of hull 26, and straps 52 and 53 are rigid with the sections 20 of the pair of telescopic sections 16, respectively. Rings 30 and 31 provided for attaching the guys 27 and 28 are rigid with the lateral arms 43 and 44, respectively. All the other elements are identical with those of the first form of embodiment (FIG. 1).

This assembly operates like the first form of embodiment. After assembling the elements 42, 43, 44 and mast 8, the telescopic intermediate sections 16 are inserted into the corresponding holes 22 and 24 of rowlocks 23 and 35, respectively. The three arms 42, 43 and 44 are engaged through the corresponding and previously opened straps 51, 52 and 53, respectively, which are subsequently closed, and the butterfly screws 36 are tightened, thus completing the assembling operation.

The supporting device according to the present invention way be used notably whenever a single-hull inflatable boat is to be operated at will with or without sails, while preserving a considerable rigidity in this last instance.

It will readily occur to those conversant with the art that various modifications and changes may be brought to the specific forms of embodiment described and illustrated herein without departing from the basic principles of the invention as set forth in the appended claims.

What is claimed as new is:

1. A sail boat, comprising;

a flexible hull having side floats on sides thereof, which floats are inflated in use;

a sail mast having sail-setting guys each having a first end connected to a top end portion of the mast, and a second end connectable to the hull;

a rigid mast support having an element connectable to a bottom end portion of the mast, and a plurality of side arms connected with said element and laterally extending therefrom diverging from one another; and a corresponding plurality of connectors each secured to one of the inflated side floats, disposed on top thereof, and releasably connectable, each with a free end portion of one of the side arms;

each of said connectors comprising a pair of rings coaxially secured to the corresponding side float at positions spaced along the float; each side arm having a first telescopic element secured to the free end portion of the arm, said telescopic element having an end portion insertable, in use, in one of the respective rings, a second telescopic element shiftable along the first telescopic element for similar insertion in the other of the respective rings, and means for releasably securing the first and second telescopic elements when so inserted, against sliding relative to one another and to the rings;

thereby facilitating releasable connection of the mast and support with the inflated side floats.

2. A boat according to claim 1 wherein the flexible hull also has an inflatable fore float; the mast support having a rigid jib arm extending, in use, from the rigid element to the inflated fore float; the mast having a stay connected at one end thereof to the top end portion of the mast and connectable at another end thereof with a fore end portion of the jib arm.

3. A boat according to claim 1 wherein the rigid element of the mast support comprises sockets diverging from said element, the side arms being rigidly inserted in the sockets; and the second end of each guy being, in use, connected to one of the inflated side floats of the hull adjacent a free end of one of the side arms.

4. A sail and row boat, comprising;

a flexible hull having a pair of inflatable side floats, disposed respectively at opposite sides of the hull, each float having a first and a second oarlock ring secured thereto for use in rowing the boat, the oarlock rings being disposed on top of the side floats when the floats are, in use, inflated;

a sail mast having sail-setting guys terminally connected thereto and to the hull;

a rigid mast support having an element connectable to a bottom end portion of the mast, and a pair of side arms connected with said element, laterally extending therefrom, diverging from one another;

a pair of elongate connector elements, each secured to a free end of one of the side arms, extending transversely thereof, and having free, first and second end portions insertable respectively in the first and second oarlock rings of the corresponding side float when the floats are, in use, inflated; and means for releasably securing the so inserted end portions against displacement longitudinally of the inflated float;

thereby facilitating conversion of the hull with inflated floats from a hull for rowing into a hull for sailing and vice versa.

5. A boat according to claim 4 wherein each guy has a first end secured to a top portion of the mast, and a second end secured, in use, to one of the side floats adjacent one of the oarlock rings.

6. A boat according to claim 5 wherein the hull also has an inflatable fore float; the mast support having a jib arm extending, in use, to the inflated fore float from the rigid element; the mast having a stay connected at one end thereof to the top portion of the mast and connectable at another end thereof with a fore end portion of the jib arm and thereby with the fore float.

* * * * *